US006318993B1

(12) United States Patent
Huang

(10) Patent No.: US 6,318,993 B1
(45) Date of Patent: Nov. 20, 2001

(54) PLURALITY FINGERED BURNER

(75) Inventor: Vincent M. S. Huang, La Palma, CA (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 0 days.

(21) Appl. No.: 09/577,281

(22) Filed: May 23, 2000

Related U.S. Application Data

(63) Continuation-in-part of application No. 08/955,002, filed on Oct. 20, 1997.

(51) Int. Cl.[7] ..... F23D 14/02
(52) U.S. Cl. ..... 431/354; 126/39 R
(58) Field of Search ..... 431/354, 264, 431/266; 126/39 R, 215

(56) References Cited

U.S. PATENT DOCUMENTS

| | | | | |
|---|---|---|---|---|
| 2,023,624 | | 12/1935 | Tullis . | |
| 3,044,459 | | 7/1962 | Brown . | |
| 4,773,383 | | 9/1988 | Gouville et al. . | |
| 5,133,334 | | 7/1992 | Riehl . | |
| 5,405,263 | * | 4/1995 | Gerdes et al. | 431/354 |
| 5,490,778 | | 2/1996 | Meijer . | |

FOREIGN PATENT DOCUMENTS

| | | | | |
|---|---|---|---|---|
| 49497 | | 11/1909 | (CH) . | |
| 93 18 510 | | 7/1994 | (DE) . | |
| 0 491 580 A | | 6/1992 | (EP) . | |
| 0 581 655 A | | 2/1994 | (EP) . | |
| 719982-A1 | * | 7/1996 | (EP) | 431/354 |
| 2 701 542 | | 8/1994 | (FR) . | |
| 158331 | | 1/1921 | (GB) . | |
| 2240168 A | * | 7/1991 | (GB) | 431/354 |
| 2302940-A | * | 2/1997 | (GB) | 431/354 |
| WO-9830838 | * | 7/1998 | (WO) | 431/354 |

* cited by examiner

*Primary Examiner*—Sara Clarke
(74) *Attorney, Agent, or Firm*—Brooks & Kushman P.C.

(57) ABSTRACT

Cooking appliances including burners particularly configured to improve heating and reduce exposure of the burner above the cooktop include a burner head defining a chamber enclosed by a peripheral wall and a plurality of burner ports communicating between the chamber and the exterior of the head. A burner cap covers the burner head, and the burner head preferably includes extended fingers to improve the dispersion of the burner flame. Preferably, the burner cap conforms with the shape of the burner head. In addition, the burner includes a base for supporting the burner on a cooktop opening. The burner base and the burner head include openings to form a primary flow passage for drawing the flow of gas to the burner. In addition, secondary flow passages communicate with secondary bypass ports formed in the burner body, preferably in the head or between the burner head and other burner parts.

18 Claims, 6 Drawing Sheets

FIG 5
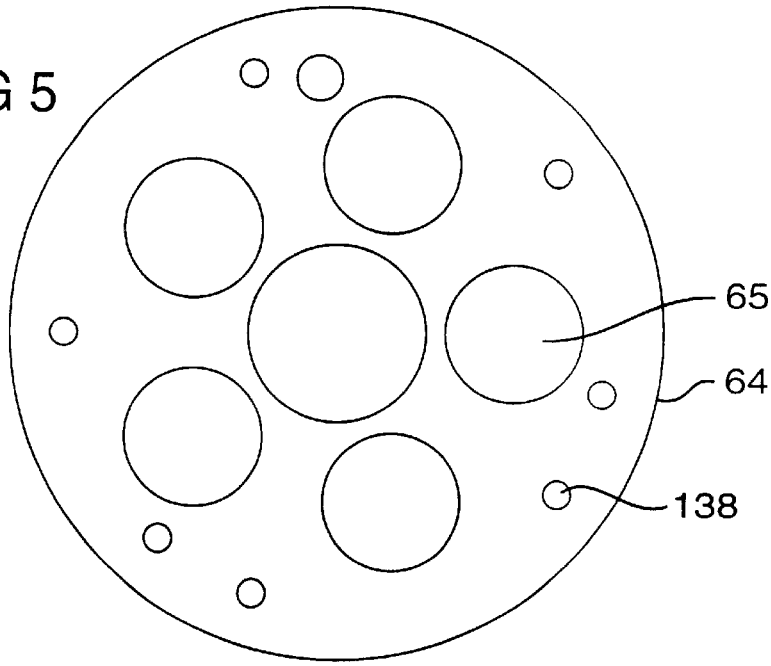
FIG 6
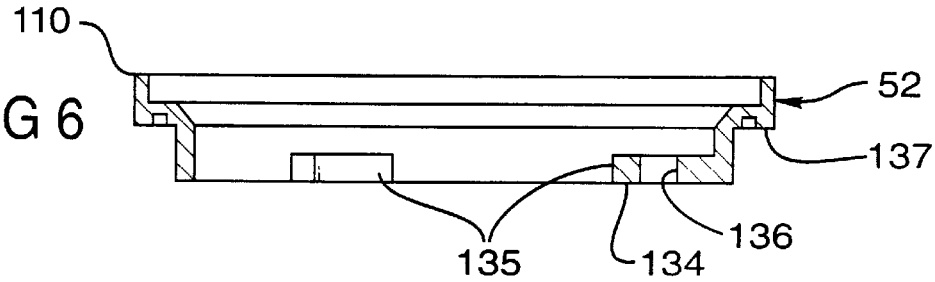
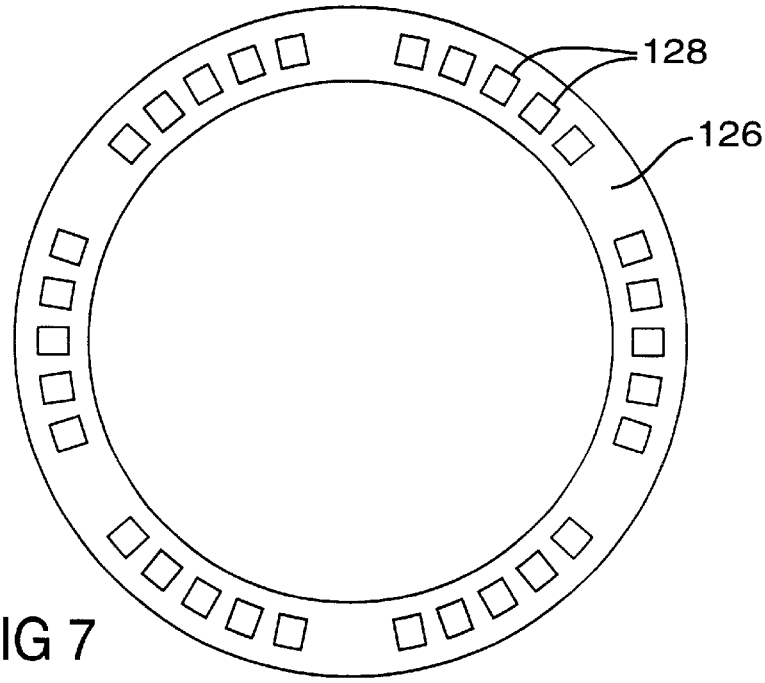
FIG 7

FIG 8
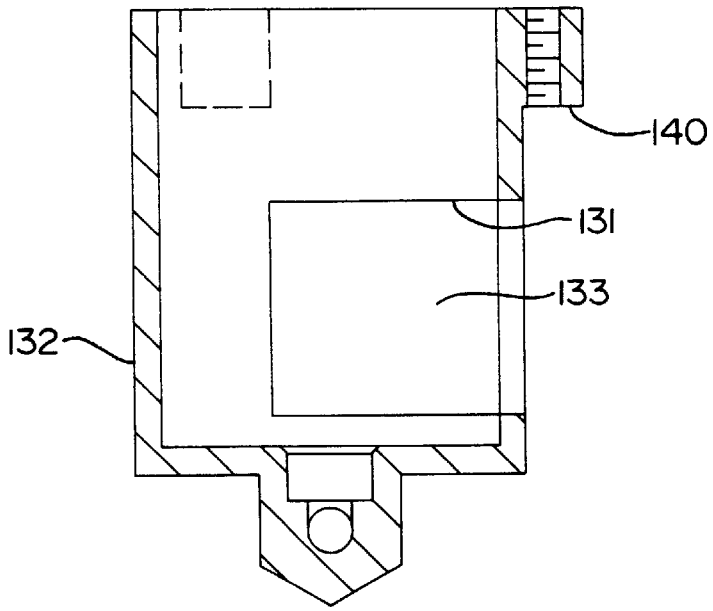
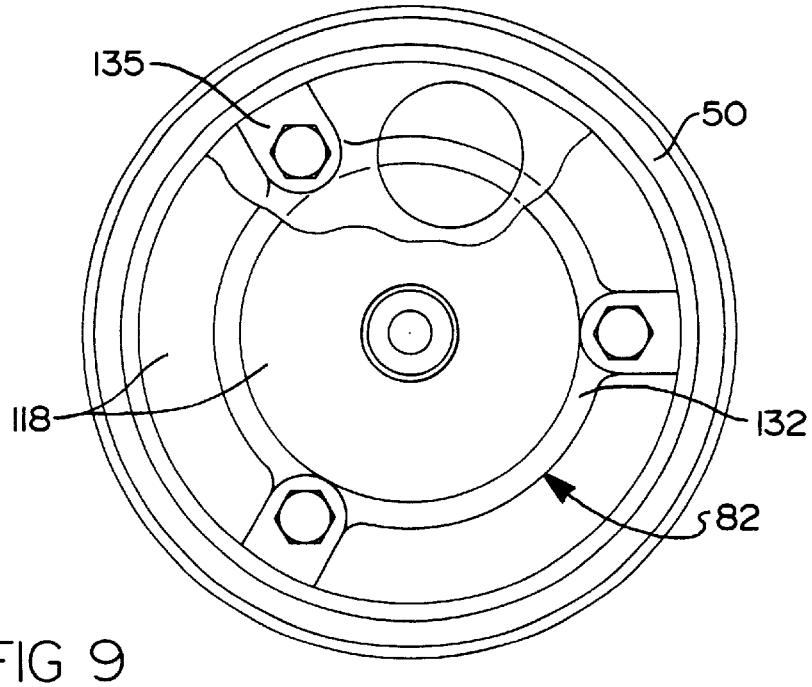
FIG 9

PLURALITY FINGERED BURNER

CROSS-REFERENCE TO RELATED APPLICATIONS

The application is a continuation-in-part of U.S. application Ser. No. 08/955,002 filed Oct. 20, 1997.

FIELD OF THE INVENTION

The present invention relates to sealed cooktop burners including primary and secondary air passages, preferably throughout a plurality of burner head fingers covered by a burner cap.

DESCRIPTION OF THE PRIOR ART

Many previously known cooktop burners provide a limited flame area. Typically, the burners are circular and form a ring of flame which can engage the bottom of a utensil only at a limited area. Moreover, the flame tends to spread outwardly towards the outer edges of the utensil, whereby the central portion of the utensil within the ring may be relatively cooler than the remaining surface area, and particularly, cooler than the area constantly subjected to contact with the flame. Although some previously known burners have been provided with elongated extensions in order to expose burner ports to various positions along the bottom of the cooking utensil, these previously known configured burners were exposed to leakages from the cooking utensil. Such leakages may cause blockage of burner ports and further contribute to uneven heat distribution over a burner.

Although ring burners have been covered with caps in order to avoid exposure of the burner ports to clogging, the radially expanded cap distributes the flame ring wider, and thus contributes to the heating differential at the center of the cooking utensil over the center of the burner. Moreover, while capped burners are often raised above a supporting surface so that secondary air can contribute to the flame production as the primary flow of fuel and air mixture passes through the burner ports, recent cooktop innovations have lowered the burner so as not to expose a protruding, interfering surface above the cooktop surface of the appliance. However, lowering of the burner in the cooktop interferes with the free flow of secondary air near the burner ports that receive and discharge a primary fuel and air mixture. In addition, cooktop designs that provide sealed burner openings restrict access to secondary air within the appliance and prevent its use as secondary bypass air near the burner ports.

SUMMARY OF THE INVENTION

The present invention overcomes the above-mentioned disadvantages by providing a configured, capped burner that reduces the heating differential across the bottom of a heating utensil without exposing the burner ports to clogging from leakage that may occur from a cooking utensil. In addition, the present invention provides passages for secondary air, as well as passages for primary air, and the arrangement of ports does not interfere with the sealing of the burner opening in the cooktop. Moreover, the present invention provides a low profile burner configuration for use in a sealed cooktop providing easier maintenance and more efficient heating than previously known cooktops for cooking appliances.

In general, the burner includes a burner body that comprises a burner head, including a chamber enclosed by a peripheral wall and a plurality of burner ports communicating between the chamber and the exterior of the head. Preferably, the burner is configured with a plurality of fingers and the body includes a cap that extends over the burner head covering the ports in the burner head. In addition, a burner base supports the burner in a cooktop opening, preferably in sealing engagement with the cooktop panel. A plurality of bypass ports between the burner head and at least one of the burner cap and the burner base provide secondary air flow to aid flame propagation.

In the preferred embodiment, a star-shaped burner includes five fingers, each of the fingers being provided with a plurality of burner ports covered by the cap and in fluid communication with the chamber. A venturi port in the chamber receives a venturi tube communicating below the burner with a gas supply jet. Preferably, the gas supply jet is carried by a jet holder beneath the sealed surface in an enclosure wall in the cooktop appliance. In addition, the venturi tube cooperates with adjacent structure to couple a plurality of ports at the lower end of the burner head with secondary air through a bypass passageway, preferably through openings in a mounting plate. The burner base is sealingly engaged in an opening on the cooktop to seal the low profile burner in position on the cooktop surface.

The present invention also provides low profile burners with secondary air bypass capability intended for use in sealed burner cooktops where ambient air cannot be provided in sufficient quantities to support proper flame and ignition at all burner ports throughout the configuration of the cap. In addition, the present invention provides configured burners that reduce the area of the heat gradient and permits greater control of heat application to the bottom of the cooking utensil.

BRIEF DESCRIPTION OF THE DRAWINGS

The present invention will be more clearly understood by reference to the following detailed description of a preferred embodiment when read in conjunction with the accompanying drawings, in which like reference characters refer to like parts throughout the views, and in which:

FIG. 5 is a top view of the locking plate shown in FIG. 3;

FIG. 6 is a sectional view of the burner base shown in FIGS. 4 and 9;

FIG. 7 is a plan view of the annular ring shown in FIG. 4;

FIG. 8 is a side view of the jet holder shown in FIG. 4; and

FIG. 9 is a sectional view taken substantially along the line 9—9 in FIG. 4.

DETAILED DESCRIPTION OF THE PREFERRED EMBODIMENT

Figure 1:
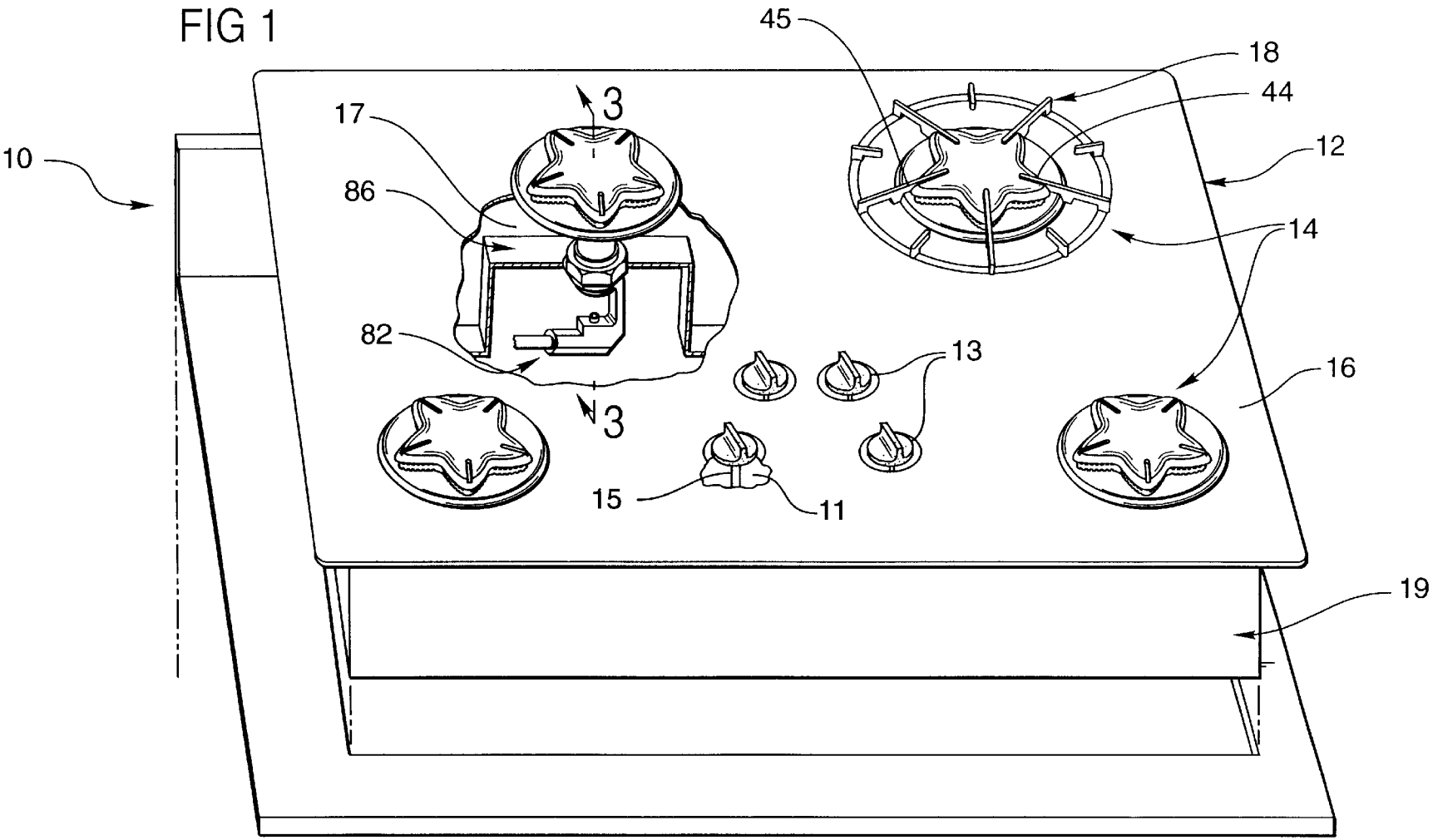
FIG. 1 is a perspective view of an appliance with a cooktop having burners constructed in accordance with the present invention.

Referring first to FIG. 1, a cooking appliance 10 is shown having a cooktop 12 including a plurality of burners 14. The cooktop 12 includes surface panel 16 having a plurality of openings 17 defining the positions for each of the burners 14. Each burner supports a grate 18 to support a cooking utensil, such as a pot, pan or kettle over the burner. In the preferred embodiment, the surface panel 16 forms a sealed burner arrangement which is to be discussed in greater detail below. In addition, control knobs 13 are carried on valve stems 15 protruding through openings 11 in the cooktop 12. The control knobs 13 are used to control the valve for flow of gas and the ignition of the burner in a well known manner. The openings 11 may contribute to the availability of secondary air within the appliance since the openings are not positioned where leakage or overspills from cooking utensils will expose the burner or the ignitor to clogs or blockages that may interfere with operation of the burners.

In addition, the cooktop 12 carries a rough-in box 19 that encloses the cooktop controls and burners for installation in a rough-in opening in a cabinet or countertop. The rough-in box 19 enclosure preferably includes a bottom wall to prevent spillage through cooktop openings 11 from soiling the interior of the cabinet. In addition, the bottom of the rough-in box 19 provides support for a bracket 86 used to support a jet holder 82 as described in greater detail below.

Figure 2:
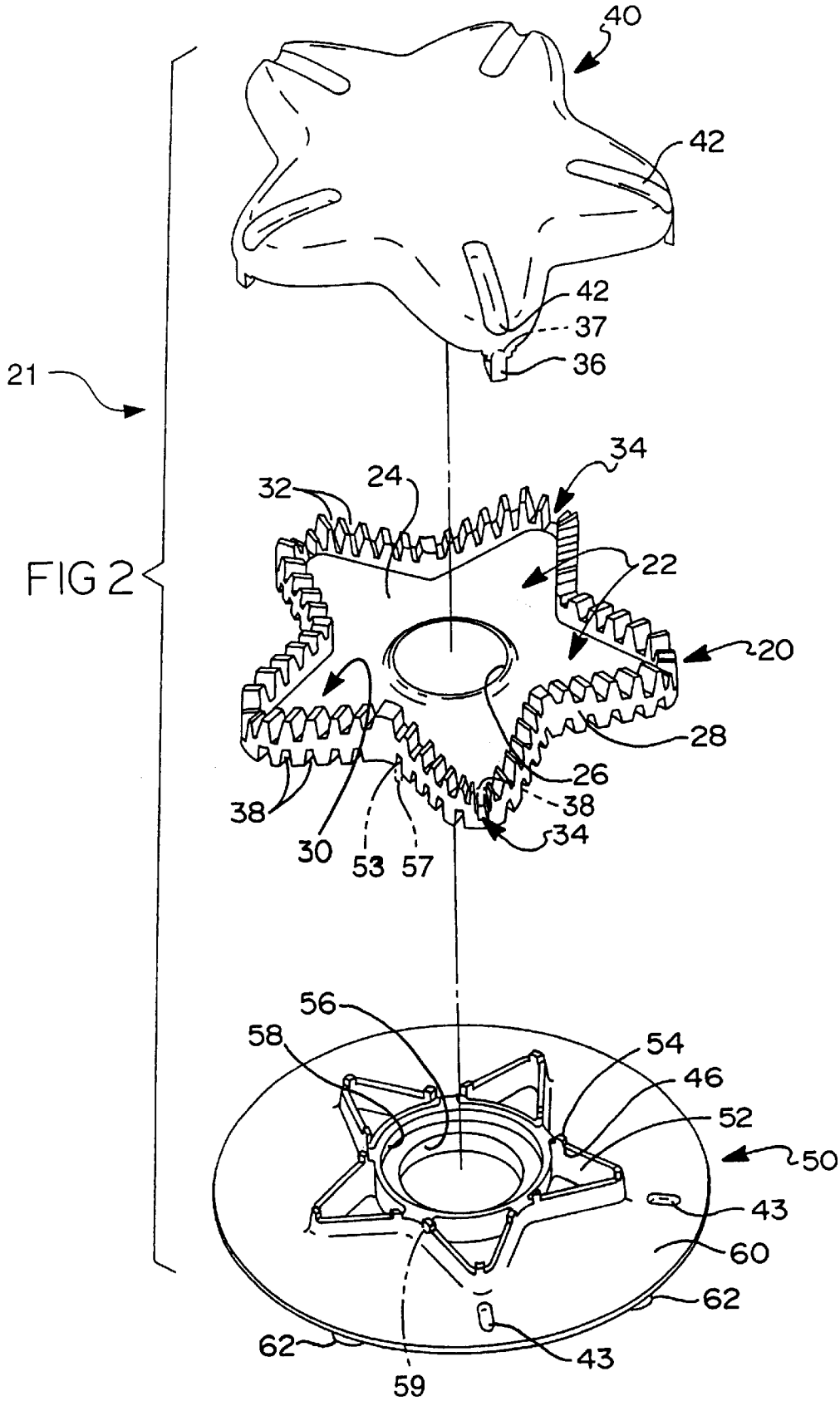
FIG. 2 is an exploded perspective view of a burner shown in FIG. 1 with parts, such as the venturi tube, removed for the sake of clarity.

Referring now to FIG. 2, a burner 14 includes a body 21, preferably formed by a plurality of stacked parts. In the preferred embodiment shown, the body includes a burner head 20 having a plurality of fingers 22. In the preferred embodiment, five fingers 22 form a star configuration. A central wall 24 includes an opening 26. The central wall 24 and the peripheral wall 28 define a chamber 30. The upper portion of the peripheral wall 28 includes a plurality of recesses forming ports 32 in fluid communication with the chamber 30 and the exterior of the burner head 20.

The burner head 20 includes a support for a burner cap 40, for example, sockets 34 for receiving legs 36 of the burner cap 40. The burner cap 40 includes a walled enclosure with an upper surface, the wall enclosing the chamber 30 and having a contour configured to cover the ports 32 over each of the fingers 22 in the burner head 20. In the preferred embodiment, the upper surface of the burner cap 40 includes a plurality of recesses 42 adapted to receive a portion of a connector leg 44 (FIG. 1) of a grate 18.

Figure 3:
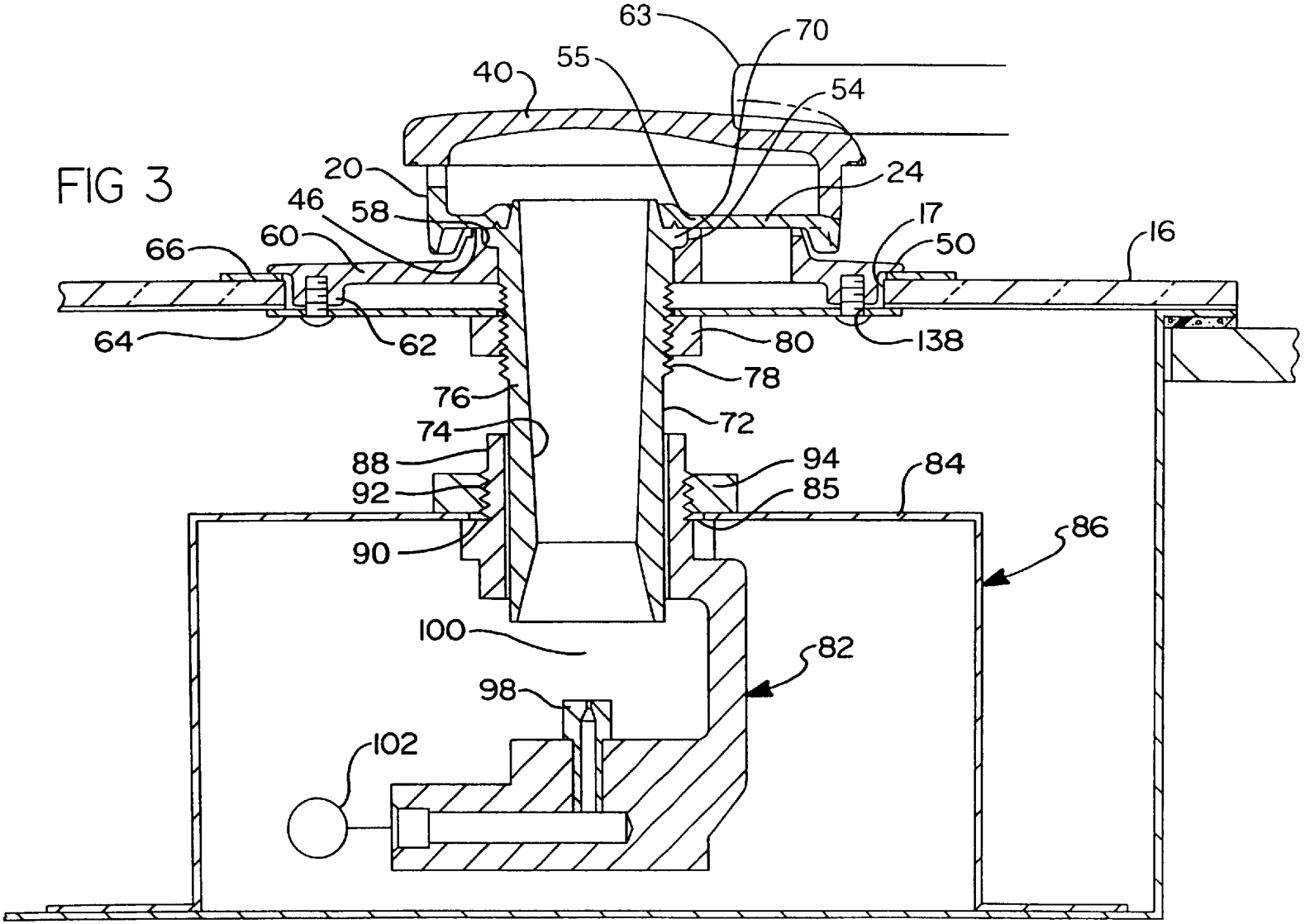
FIG. 3 is a sectional view of burners shown in FIGS. 1–3.

The burner 14 also includes a base 50 having a base wall 60 and a support wall 52 including raised legs 54 (FIGS. 2 and 3) that support the burner head 20 above the base 50. The support legs are preferably located at a position radially inwardly from the peripheral wall 28 of the burner head 20 as shown in FIG. 3. The legs 54 define intermediate openings 46 (FIGS. 2 and 3) that are arranged throughout the periphery of the base 50 for communicating with recesses that form ports 38 in the lower portion of the peripheral wall 28 of the burner head 20.

In addition, the burner base 50 also includes a central aperture 56 peripherally defined by a venturi seat 58. The base wall 60 conforms with the shape of the opening 17 in the cooktop for support of a burner 14 at the burner location. Preferably, a flange on the base 50, for example, the peripheral edge of wall 60, is slightly larger than the size of the opening 17 so that the base 50 of the burner seals against the surface panel 16 and prevents leakage of food products, overspills and the like from falling into the burner and related parts carried in the interior of the appliance 10. Similarly, the burner base 50 includes at least one recess 43 for protruding portions of the connector leg 44 to maintain the grate 18 in a fixed position on the cooktop 12 when the burner base 50 is mounted to the cooktop as discussed below. Nevertheless, the grate 18 may be easily lifted out of its maintained position to permit cleaning, removal or disassembly of the burner 14.

As best shown in FIG. 3, the bottom of the base wall 60 includes threaded bosses 62 received in the opening 17 of the surface panel 16, and the bosses 62 receive screws extending through openings 138 in a locking plate 64. The locking plate 64 is also preferably larger than the opening 17 in the surface panel 16 so that the surface panel, preferably made of glass, can be sandwiched between the outer edge of the base 50 and the locking plate 64 at the periphery of the opening 17 in the surface panel 16. Preferably, a gasket or trim ring 66 is lodged between the lower surface of the base wall 60 and the exposed surface of the surface panel 16 around the opening 17 to seal the burner 14 to the cooktop 12. The cooktop 12 is in turn secured to the countertop with the rough-in box 19 extending through the opening in the countertop. A seal such as a foam gasket is positioned between the edge of the cooktop and the countertop at the periphery of the opening in the countertop. In this manner, the cooktop 12 can be sealed in position in the cabinet, although it will be understood that other cooktop constructions such as a self-contained stove may also be used to support the cooktop 12 in a well known manner.

The burner base 50 retains the grate 18, the burner head 20 and the cap 40 in position by receiving portions of the legs on grate 18. Portions 44 and 45 are received in the recesses 42 and 43 in the cap 40 and the base 50, respectively. The legs 54 and 44 rest in sockets to restrict lateral displacement of the grate 18, but permit disassembly for cleaning once the grate 18 is removed by lifting it above the stacked burner parts 40, 20 and 50.

A mounting flange 70 at the end of a venturi tube 72 is seated upon the venturi seat 58 (FIGS. 2 and 3) and retained in position by the central wall 24 of the burner head 20. However, this assembly may be modified for example, as the wall 24 and tube 72 may be made in one piece. The venturi tube 72 includes a venturi passage 74 through an elongated body 76. The body 76 includes an exterior, threaded portion 78 adapted to receive the nut 80 to lock the venturi tube 72 into position on the secured burner base 50.

The lower end of the venturi tube body 76 is received in a jet holder 82. The jet holder 82 is carried by a wall 84 of a bracket 86 supported by the bottom wall of the rough-in box 19. The jet holder 82 includes a retainer sleeve 88 including an annular shoulder 90 abutting one side of the wall 84 while threaded portion 92 extends through an opening 85 in the wall 84. The threaded portion 92 receives a nut 94 to lock the jet holder 82 to the bracket 86.

The jet holder 82 positions a gas nozzle 98 for introducing gas for mixture with air and entry into the venturi passage 74 as is well known in the prior art. The nozzle is coupled to a supply of gas 102 and discharges the fuel to a mixing zone 100 adjacent the entry to the venturi passage 74.

When each burner 14 is installed as shown in FIG. 3, and the supply 102 of gas delivered through the nozzle 98 is mixed with air at the mixing zone 100 to form primary air, the primary air enters the venturi passage 74 for delivery to the chamber 30. The primary air mixture then passes through the burner ports 32 so that upon ignition by an appropriate ignitor (not shown), the flame may be initiated and sustained at the exterior of the burner head 20. The secondary air passages are formed by the ports 38 in the burner head 20, the intermediate spaces 46 between the legs 54 and the burner base, and the openings 65 (FIG. 5) in locking plate 64.

Figure 4:
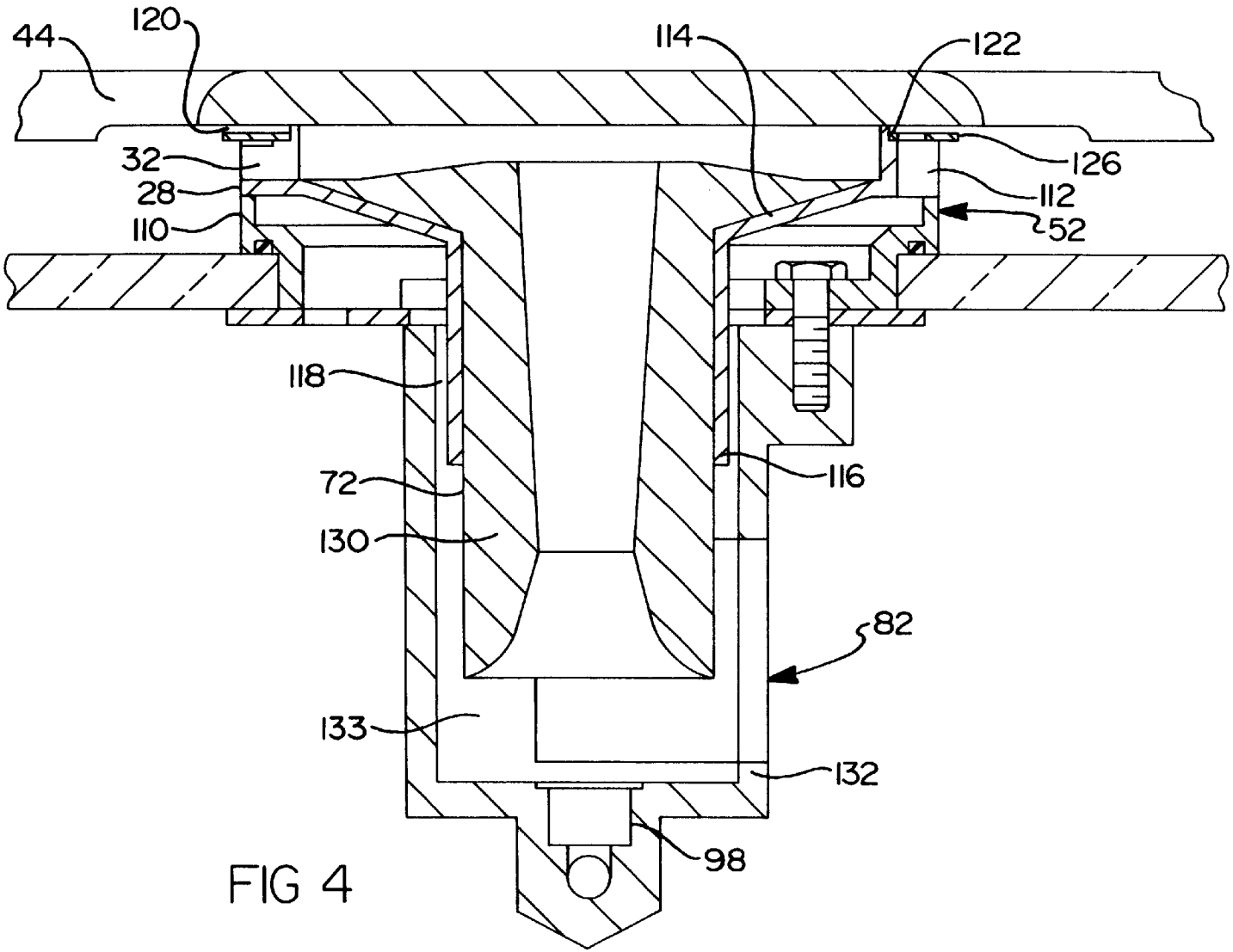
FIG. 4 is a sectional view similar to FIG. 3 but showing a modified burner construction according to the present invention.

Referring now to FIG. 4, a modified form of burner 14 also comprises a combination of a burner head 20, a cap 40 and a burner base 50, although each of these components has differently configured walls. In particular, the burner head peripheral wall 28, the support wall 52, and the cap 40 are circular. However, the peripheral wall 52 includes a continuous rim 110 supporting the peripheral wall 28. In addition, burner ports 32 are interspersed between passages 112. The passages 112 communicate with an annular space between the conical wall 114 at the end of a venturi sleeve 116 on the burner head and the peripheral wall of the base 50 to define a secondary air bypass passage 118 (FIGS. 4 and 9). Appropriate indexing means for arranging the stack of burner parts, for example, a structure similar to the above described socket arrangement receiving support legs 54, may be included to properly index the burner head with the burner base. In addition, the burner head 20 includes additional bypass ports 120 between the cap 40 and the burner head 20, as well as bypass passages 112 between the body 20 and the base 50. In the preferred embodiment, a notch 122 carries an annular ring 126. The annular ring 126, as best shown in FIG. 7, includes ports 128 that communicate between the bypass ports 112 and the bypass ports 120.

The venturi tube 72 is formed by a body 130 defining the venturi passage 74. An expanded flange includes surfaces that match the conical wall 114 of the sleeve 116 of the burner base 20. The venturi tube 72 and the sleeve 116 can also be formed into one piece.

The venturi tube 72 extends into a jet holder 82 including a body 132. As with the previous embodiment, the jet holder 82 supports a nozzle 98 for coupling a supply of gas to the venturi passage 74 for mixture with air supplied through openings 131 (FIG. 8) to form a primary fluid flow. In addition, the chamber 133 (FIG. 8) enclosed by the body 132 separates the holder body 132 from the periphery of the body 130 of the venturi tube to form the secondary air passage 118. The secondary air passage 118 is a divided passageway as shown in FIG. 9 if a locking plate 64 is configured as shown in FIG. 5.

In the preferred embodiment of FIG. 4, the base 50 includes a bottom wall 134 in the form of tabs 135 having apertures 136. As shown in FIG. 6, a flange 137 overlaps the surface panel 16 at the rim 110 of the base 50. The bolt extended through the opening 136 extends through an opening 138 in the locking plate 64 and is threaded into a threaded boss 140 carried by the jet holder body 132 (FIG. 8).

In the embodiment of FIG. 4, the bypass passages 118 may be provided above the ports 32, as well as adjacent to the ports 32. In addition, the secondary air bypass ports can be below the primary air ports 32, as shown in the FIG. 3 embodiment, and combinations of these arrangements are also within the scope of the present invention.

The invention includes indexing means for arranging a stack of a burner cap, a burner head and a burner base in which a plurality of legs on one of the burner cap, burner head, and burner base can be mated with a plurality of sockets on an adjacent one of the burner cap, burner head, and burner base. Similarly, the grate may be indexed with respect to the multiple piece burner body when one of the grate and the burner body includes legs and the other of the grate and the burner body includes a plurality of sockets receiving the legs to arrange the grate on the burner body. Indexing alternatives, for example, the alternatives of legs and sockets on the cap and burner head, are shown at 36 and 37 in FIG. 2. Similarly, legs and receiving sockets on either of the head and the base are shown at 53 and 57 in FIG. 2 as well as 59 in FIG. 2. Similarly, formation of a leg on a burner cap being received in a recess of the grate 18 is shown at 63 in FIG. 3.

Having thus described the present invention, many modifications thereto will become apparent to those skilled in the art to which it pertains without departing from the scope and spirit of the present invention as defined in the appended claims.

What is claimed is:

1. A burner including a burner body defining a plurality of ports, said burner body being shaped with a plurality of fingers, each finger having a peripheral wall including said plurality of ports extending through said peripheral wall, the ports of said plurality being distributed from a distal end to a proximate end of each finger, said burner body having a primary air passageway adjacent said proximate end of each finger and coupled in fluid communication with each of said ports; wherein said body includes a head, a cap having a contour configured to extend beyond the ports over each of the fingers, and a base to support said head; wherein said base includes a base wall for sealing said burner to a cooktop panel; and wherein said base includes a support wall configured in alignment with said peripheral wall; wherein said burner body comprises a head including a central wall and said peripheral wall, said central wall and said peripheral wall defining a chamber in communication with said plurality of ports.

2. The invention as defined in claim 1 wherein said central wall includes an opening forming said primary air passageway.

3. The invention as defined in claim 1 wherein one of said burner cap and said head includes legs and the other of said cap and said head includes sockets adapted to receive said legs.

4. The invention as defined in claim 1 wherein said support wall includes a plurality of legs.

5. The invention as defined in claim 4 wherein said legs define intermediate openings about said support wall on the base.

6. The invention as defined in claim 5 wherein said peripheral wall includes recesses in communication with said intermediate openings.

7. The invention as defined in claim 4 wherein said burner head includes sockets for receiving said plurality of legs to index said head in a stack on said base.

8. A cooktop for a cooking appliance comprising:

a support panel including at least one burner opening; and at least one burner body mounted for disassembly in said opening, said burner comprising a burner head having a plurality of fingers formed by a peripheral wall, each finger extending outwardly from a primary air opening and including a plurality of peripheral ports; a burner cap configured to cover the ports over each of the fingers, and a burner base having a base wall configured to conform with the shape of said burner opening and a support wall configured in alignment with said peripheral wall.

9. The invention as defined in claim 8 wherein said head is stacked on said base.

10. The invention as defined in claim 9 wherein said cap is stacked on said burner head.

11. The invention as defined in claim 10 wherein said burner body includes indexing means for arranging a stack of said burner cap, said burner head and said burner base.

12. The invention as defined in claim 11 wherein said indexing means comprises a plurality of legs on one of said burner cap, burner head and burner base, and a plurality of sockets on an adjacent one of said burner cap, burner head and burner base.

13. A burner body comprising:

a burner head having a plurality of fingers formed by a peripheral wall, each finger extending outwardly from a primary air opening and including a plurality of peripheral ports;

a burner cap configured to extend beyond the ports over each of the fingers;

a burner base with a base wall, having a central aperture and support walls configured in alignment with said peripheral wall and surrounding said central aperture; and indexing means for arranging a stack of said burner cap on said burner head on said burner base in a low profile when said fingers and support walls are aligned as configured.

14. A burner including a burner body defining a plurality of ports, said burner body being shaped with a plurality of fingers, each finger having a peripheral wall including said plurality of ports extending through said peripheral wall, the ports of said plurality being distributed from a distal end to a proximate end of each finger, said burner body having a primary air passageway adjacent said proximate end of each finger and coupled in fluid communication with each of said ports, wherein said body includes a head, a cap having a contour configured to extend beyond the ports over each of the fingers, and a base to support said head; wherein said base includes a base wall for sealing the burner to a cooktop panel, and a support wall configured in alignment with said peripheral wall; wherein said support wall includes a plurality of legs; wherein said legs define intermediate openings about the periphery of the base; and wherein said peripheral wall includes recesses in communication with said intermediate openings.

15. A burner including a burner body defining a plurality of ports, said burner body being shaped with a plurality of fingers, each finger having a peripheral wall including said plurality of ports extending through said peripheral wall, the ports of said plurality being distributed from a distal end to a proximate end of each finger, said burner body having a primary air passageway adjacent said proximate end of each finger and coupled in fluid communication with each of said ports; wherein said body includes a head, a cap having a contour configured to extend beyond the ports over each of the fingers, and a base to support said head; wherein said base includes a base wall for sealing the burner to a cooktop panel, and a support wall configured in alignment with said peripheral wall; wherein said support wall includes a plurality of legs; and wherein said burner bead includes sockets for receiving said plurality of support legs to index said head in a stack on said base.

16. The invention as defined in claim 15 wherein one of said burner cap and said head includes legs and the other of said cap and said head includes sockets that receive said legs to index said cap in said stack.

17. A cooktop for a cooking appliance comprising:

a support pane including at least one burner opening; and at least one burner body mounted for disassembly in said opening, said burner comprising a burner head having a plurality of fingers formed by a peripheral wall, each finger extending outwardly from a primary air opening and including a plurality of peripheral ports; a burner cap configured to cover the ports over each of the fingers, and a burner base having a base wall configured to conform with the shape of said burner opening and a support wall configured in alignment with said peripheral wall; wherein said head is stacked on said base; wherein said cap is stacked on said burner head; wherein said burner body includes indexing means for arranging a stack of said burner cap, said burner head and said burner base; and a burner grate stacked on said burner body.

18. The invention as defined in claim 17 wherein at least one of said grate and said burner body include legs and the other of said grate and said burner body include a plurality of sockets receiving said legs to index said grate on said burner.

* * * * *

UNITED STATES PATENT AND TRADEMARK OFFICE

CERTIFICATE OF CORRECTION

PATENT NO. : 6,318,993 B1
DATED : November 20, 2001
INVENTOR(S) : Huang

It is certified that error appears in the above-identified patent and that said Letters Patent is hereby corrected as shown below:

Column 8,
Line 9, "wherein said burner bead" should read -- wherein said burner head --.
Line 17, "a support pane" should read -- a support panel --.

Signed and Sealed this

Twenty-third Day of April, 2002

*Attest:*

*Attesting Officer*

JAMES E. ROGAN
*Director of the United States Patent and Trademark Office*